United States Patent [19]

Tierney et al.

[11] Patent Number: 4,845,868

[45] Date of Patent: Jul. 11, 1989

[54] FOLDABLE TROUSERS PRESS

[76] Inventors: Martin J. Tierney, Marlbrough Rd., Glenageary, Dublin; Liam M. Birkett, 62 Rathdown Park, Terenure, Dublin, both of Ireland

[21] Appl. No.: 96,601

[22] Filed: Sep. 11, 1987

[30] Foreign Application Priority Data

Sep. 15, 1986 [IE] Ireland ..... 2466/86

[51] Int. Cl.[4] ..... D06F 71/02; D06F 71/30

[52] U.S. Cl. ..... 38/71

[58] Field of Search ..... 38/20, 69, 71, 72; 223/61, 72, 96

[56] References Cited

U.S. PATENT DOCUMENTS

| | | | |
|---|---|---|---|
| 986,850 | 3/1911 | O'Heir | 38/71 |
| 1,112,922 | 10/1914 | Leahey | 38/71 |
| 1,275,801 | 8/1918 | Van Buren | 38/71 |
| 1,420,822 | 6/1922 | Dewey et al. | 38/71 |
| 1,762,078 | 6/1930 | Richards | 38/71 |
| 3,089,265 | 5/1963 | Skanse | 38/69 |
| 3,106,761 | 10/1963 | Mohring et al. | 26/96 |
| 3,290,807 | 12/1966 | Esaka | 38/71 |
| 4,155,493 | 5/1979 | Palmaer | 223/85 |
| 4,611,419 | 9/1986 | Duplessy et al. | 38/72 X |

FOREIGN PATENT DOCUMENTS

| | | | |
|---|---|---|---|
| 826496 | 1/1952 | Fed. Rep. of Germany | 38/71 |
| 654629 | 11/1928 | France | 38/71 |
| 60-261499 | 12/1985 | Japan | 38/71 |
| 60-261500 | 12/1985 | Japan | 38/71 |
| 109911 | 10/1917 | United Kingdom | 38/71 |
| 225785 | 12/1924 | United Kingdom | 38/71 |
| 269299 | 4/1927 | United Kingdom | 38/71 |
| 272133 | 6/1927 | United Kingdom . | |
| 290465 | 5/1928 | United Kingdom . | |
| 664228 | 1/1952 | United Kingdom . | |
| 1233904 | 6/1971 | United Kingdom . | |

*Primary Examiner*—Robert R. Mackey

*Attorney, Agent, or Firm*—Ladas & Parry

[57] ABSTRACT

A foldable trousers press comprises at least two trouser press members movably mounted relative to each other so as to be movable from a position in side by side relationship to a position in which the members are located in end to end relationship, so that the members together form the total length of the trousers press, being the combined length of the members. Each member comprises a base part and a top part which are movably mounted together from an open position to a closed position in which the base part and the top part abut each other. The base part has a heating means to heat the leg of a pair of trousers located in the trousers press.

11 Claims, 6 Drawing Sheets

FOLDABLE TROUSERS PRESS

BACKGROUND OF THE INVENTION

The present invention relates to a foldable trousers press.

A trousers press is known which comprises a pair of flat members adapted to be clamped together, with at least one of the abutting surfaces having a heating element. The legs of a pair of trousers are sandwiched between the flat members and with the heating element energized, a suitable crease is formed at the front and rear of the trouser legs. This trousers press is often used in the home to maintain the desired aesthetic appearance of trousers and it may also be available in some of the more expensive hotels.

One problem, however, for people who travel extensively for long periods, particularly businessmen, is that their trousers often lose the desired crease and thus their aesthetic appearance is reduced, which is undesirable. Only very few hotels provide a trousers press and it is often expensive to have trousers pressed in such hotels. Of course, it would be completely impossible for such a person to carry a conventional trousers press as part of one's luggage.

Thus, an object of the present invention is to mitigate the above problem and provide a trousers press which is of a sufficient size to be carried as part of one's luggage and also to provide a trousers press which can be used in the home but also stored in a small space.

SUMMARY OF THE INVENTION

According to the invention, there is provided a foldable trousers press comprising at least two trouser press members movably mounted relative to each other so as to be movable from a position side by side relationship, to a position in which the members are located in end to end relationship so that the members together form the total length of the trousers press, being the combined length of the two members, each member comprising a base part and a top part movably mounted together from an open position to a closed position in which the base and top parts abut each other, at least one of said base and said top part having electrically operated heating means to heat the leg portion of a pair of trousers located in the trousers press.

BRIEF DESCRIPTION OF THE DRAWINGS

Embodiments of the invention will now be described by way of example, with reference to the accompanying drawings, in which.

DESCRIPTION OF THE PREFERRED EMBODIMENT

Figure 1:
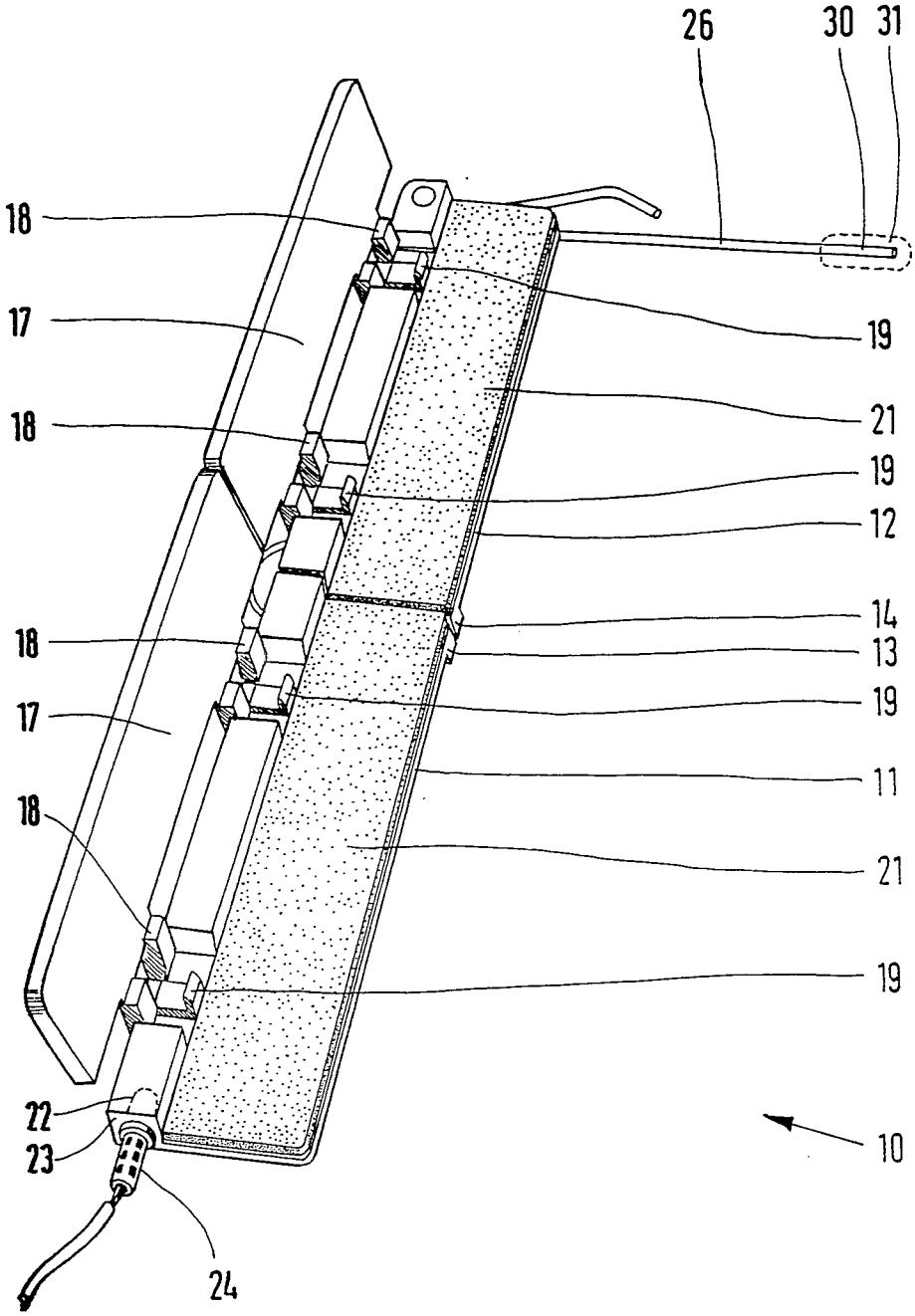
FIG. 1 is a front perspective view of a trousers press according to the invention with the top parts in an open position.
Figure 2:
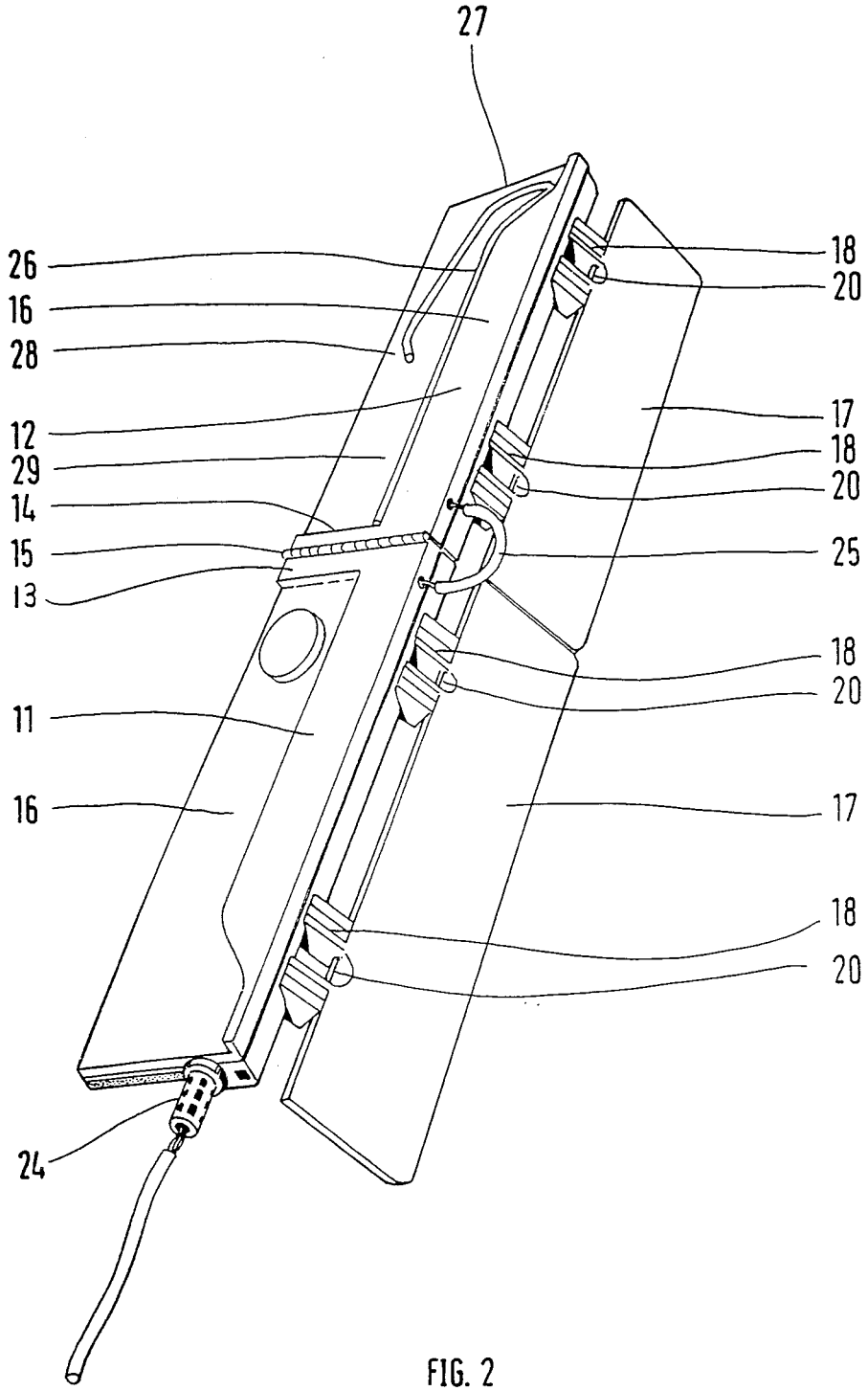
FIG. 2 is a rear perspective view of the trousers press of FIG. 1.

Referring now to the drawings wherein similar numerals have been used to indicate like parts, and referring in particular to FIGS. 1 to 4, there is shown therein a trousers press, generally indicated at 10 according to the invention. The trousers press 10 comprises two trouser press members 11, 12 pivotally connected together at adjacent ends 13, 14, respectively, by means of a hinge 15. The members 11, 12 are thus movable from a position in side by side relationship (FIG. 3) to a position in which the members are located in end to end relationship (FIG. 1) so that the members 11, 12 together form the total length of the trousers press being the combined length of the members 11, 12. Each member 11, 12 comprises a base part 16, and a top part 17. Each top part 17, is hinged to a respective base part 16, by a pair of spaced apart hinges 18. A locking means is provided to secure the top part and base part together and comprises a pair of clips 19 mounted on the base part 16, each clip 19 being disposed adjacent to a respective hinge 18, the clips 19 being an interference fit with the adjacent rearmost edge 20, of the top parts 17, so that in the closed position the base parts 16, and respective top parts 17, are held together tightly. Thus, as shown, the top parts 17, can pivot from an open position (FIG. 1) in which the top parts 17 are substantially perpendicular to the respective base parts 16, to a closed position in which the top parts 17, abut the respective base parts 16.

Figure 3:
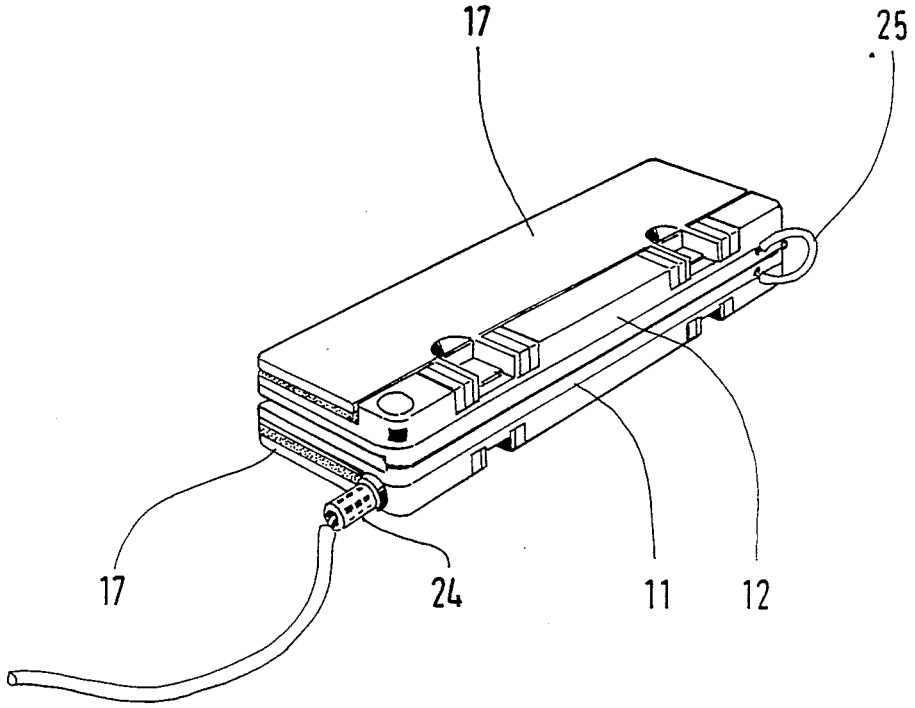
FIG. 3 is a perspective view of the trousers press of FIGS. 1 and 2 in a closed and folded position.

With each of the top parts 17, in the closed position, the trouser press members 11, 12 may be pivotted together to a position in side-by-side relationship as shown in FIG. 3 when not in use.

Each of the base parts 16, has a heater pad 21, facing the top parts 17, the heater pads 21 comprising a conventional electrically conductive plastic sheet, which is heated in conventional manner. The heater pads 21, are electrically connected to a socket 22 formed at the lower end 23 of the member 11. A power supply may be connected to the socket 22 by means of a removable plug 24 which is connected for example to a mains power supply. A flexible lead 25 passes through suitable apertures in the members 11, 12 to connect the power supply from the heater pad on member 11 to the heater pad on member 12. The trouser press members may be suitably constructed to include heat insulating materials to prevent loss of heat through the top and bottom parts 16, 17, respectively.

A hanger 26 is provided at the top end 27 of the member 12. The hanger 26 is pivotally mounted on the rear surface 28 of the member 12 and when not in use the hanger is accommodated in an elongate recess 29 formed in the rear surface 28 of the member 12. The hanger is pivotal from the position shown in FIG. 2 to a position perpendicular to the member 12, and in the same plane thereof, as shown in FIG. 1. The free end 30 of the hanger 26 is provided with a counterbalance weight 31 so that when the trousers press 10 is hung up with the hanger 26, it is balanced by the counterbalance weight. A suitable stop or clip may be provided to maintain the hanger perpendicular to the member 12. It will be noted that the width of the trousers press is only sufficient to accommodate the front or rear portion of a pair of trousers at one time.

Figure 4:
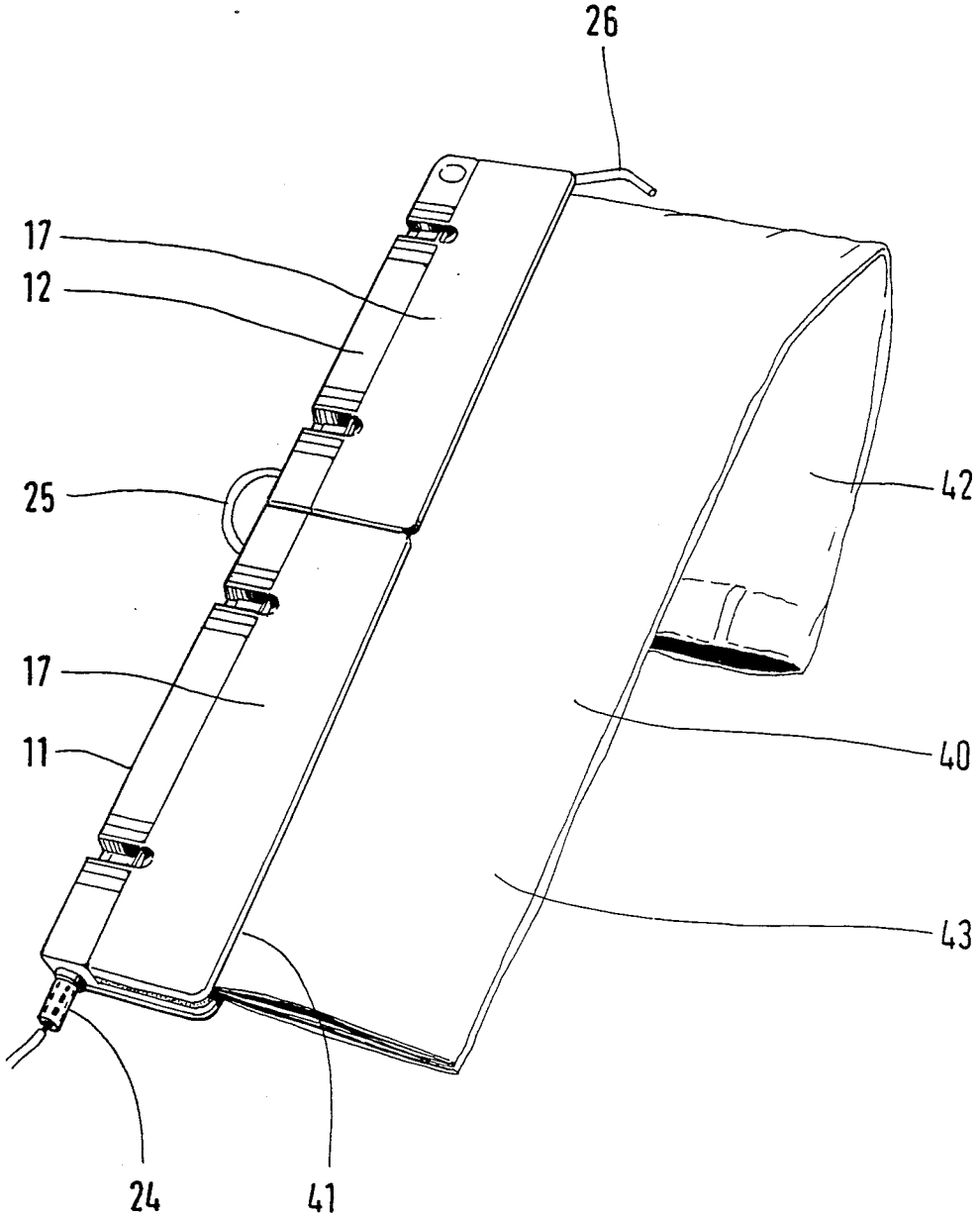
FIG. 4 is a perspective of the trousers press of FIG. 1 in use.

In use, a pair of trousers 40 is accommodated in the trousers press 10 as shown in FIG. 4. Only the front part 41 of the trousers 40 are accommodated in the trousers press 10 with the trunk part 42 of the trousers 40 folded over the hanger 26. With the top parts 17, in the closed position, the trousers press is connected to a power supply to heat the heater pads 21. The trousers press 10 may be hung on the back of a chair, or hung from other suitable support using the hanger 26. Thus, after a predetermined time period, a new crease will be formed in the front part 41 of the trousers 40. If it is desired to also provide a crease in the rear part 43 of the trousers 40 then the position of the trousers 40 in the trousers press 10 may be reversed.

When the trousers press is not in use, it is simply folded to the position shown in FIG. 3, and stored for further use. The dimensions of the trouser press 10 in the folded position is such that it is suitable to be carried in a standard size brief case carried by many business people.

Figure 5:
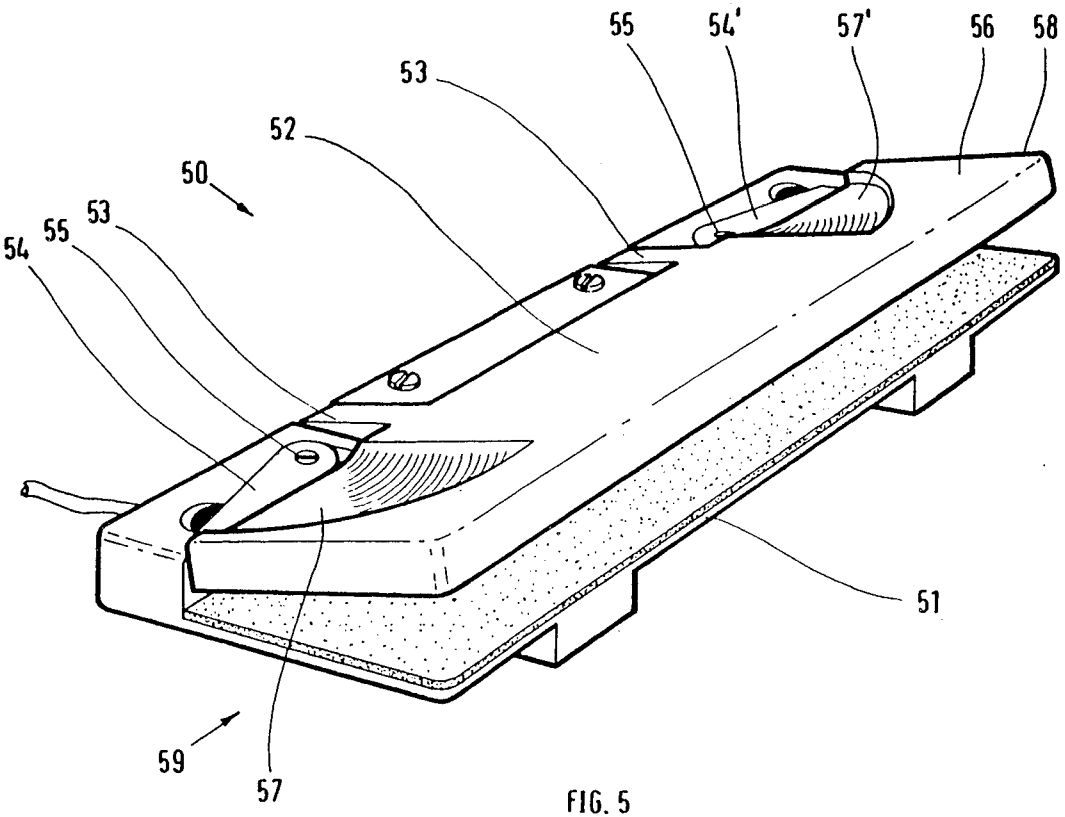
FIG. 5 is a perspective view of one trouser press member according to a second embodiment of the invention.
Figure 6:
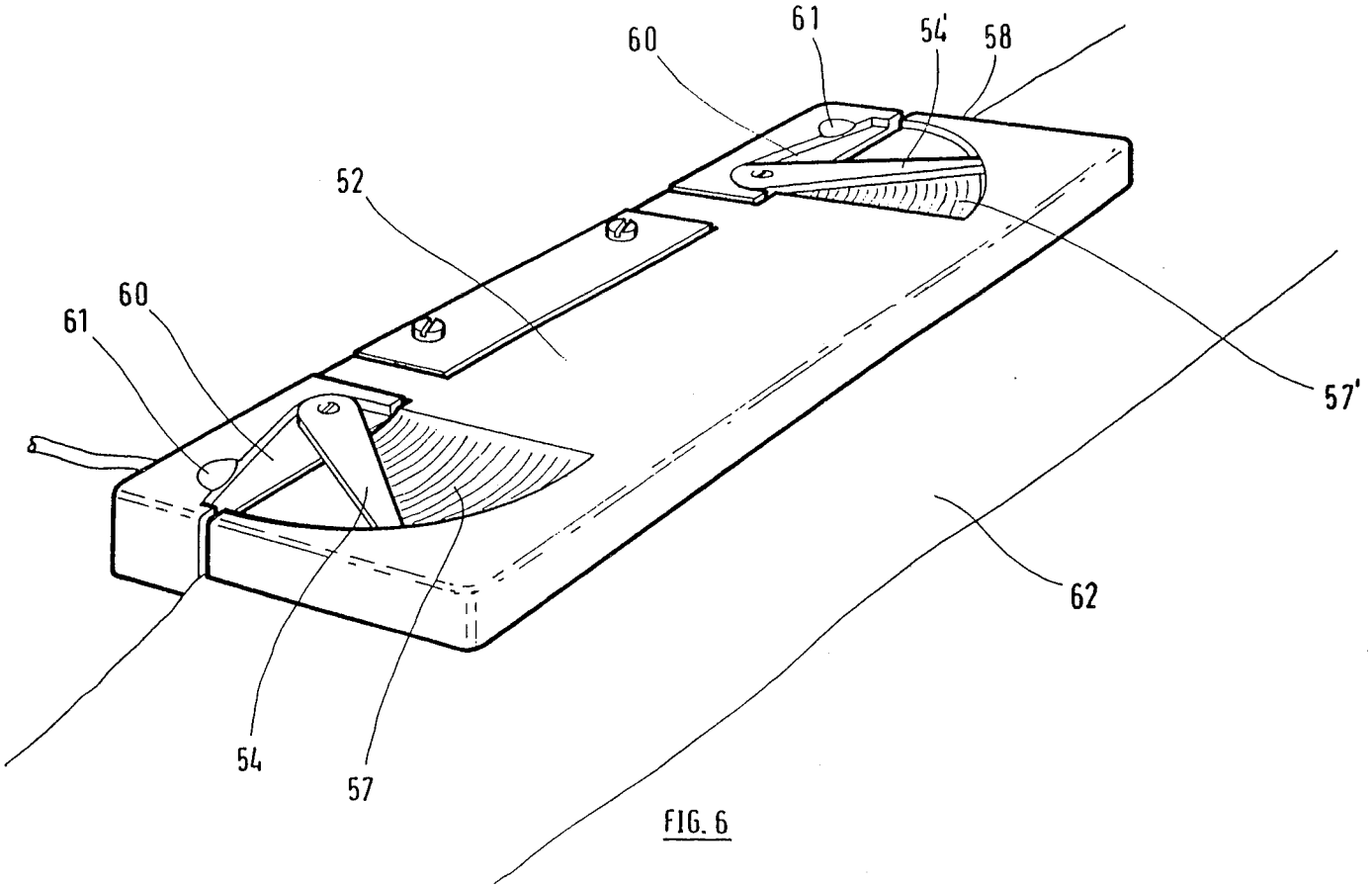
FIG. 6 is a perspective view of the trouser press member of FIG. 5 in use.

In FIGS. 5 and 6, there is shown therein another embodiment of a trousers press according to the invention. In FIGS. 5 and 6, although only one trousers press member 50 has been shown, it will be appreciated that there will be two identical such members mounted together as hereinbefore described, to provide a trousers press according to the invention. The member 50 is similar to the members 11, 12 previously described and therefore only the differences in this embodiment will be described. The member 50 comprises a base part 51 and a top part 52. The top part 52 is connected to the base part 51 by means of a resilient plastics hinge 53 which is formed as a spring member which acts to hold the base part 51 and top part 52 slightly apart as shown in FIG. 5.

A locking means is provided to secure the top part 52 and base part 51 together and comprises a pair of locking members 54, 54' rotatably mounted on the base part 51. Each locking member 54, 54' is rotatably mounted by means of a stud 55 secured in the base part 51. The upper surface 56 of the top part 52 has formed thereon, adjacent each locking member 54, 54' a sloping cam surface 57, 57' respectively of quadrant shape. The surface 57 slopes upwardly towards the top end 58 of the member 50 and the cam surface 57' slopes upwardly in the direction towards the lower end 59 of the member 50. The locking members 54, 54' may be accommodated in the recesses 60, in the base part 51 as shown in FIG. 6 and additional recesses 61, are provided to enable finger access to the members 54, 54' to enable manual rotation of them. As shown in FIG. 6, a pair of trousers 62 are located in the member 50 and the locking members 54, 54' are rotated on the cam surfaces 57, 57' respectively, which forces the top part 52 onto the base part 51 against the action of the spring loaded hinges 53 and locks the members relative to each other. The pressure exerted by the locking members 54, 54' assists in forming a crease in the trousers.

Once the locking members 54, 54' are rotated into the respective recesses 60, again, the action of the plastics hinge 53 acts to pivot the top part 52 away from the base part 51 to enable the trousers 62 to be removed from the apparatus.

In this embodiment, it may be necessary that the top part 52 be of two ply construction having a series of internally arranged ribs which would provide the necessary stiffness when the locking members are applied.

The trousers press may incorporate a conventional electrical timer circuit (not shown) to switch off the power supply to the heater pad, after predetermined time periods. The trousers press may also include a conventional thermostat to control the power supply to the heater pads 21.

We claim:

1. A foldable trousers press comprising:

at least two trousers press members movably mounted relative to each other so as to be movable from a first position in a side-by-side relation to a second position in which the members are located in an end-to-end relationship so that the members in the second position form the total length of the trousers press;

a base part and a top part forming each member, said base part and top part of each trousers press member being movably mounted so as to be movable between an open position and a closed position in which the base part and the top part abut each other;

an electrically operated heating means, fixed to at least one of said base part and top part, to heat a pair of trousers;

a locking member rotatably mounted on the base part and arranged to cooperate with a recessed cam surface formed on the top part so as to secure the top part and the base part in the closed position; and a hanger means mounted at a top end of the trousers press member which is uppermost in the second position, said hanger means being pivotally mounted on a rear surface of the base part and movable from a position in which the hanger means is accommodated in an elongated recess in the rear surface of the base part to a position in which the hanger means is perpendicular to the base part in the same plane, said hanger means having a free end that is weighted so that said hanger means remains generally horizontal when in use.

2. A foldable trousers press as claimed in claim 1, wherein said two trousers press members are pivotally mounted together.

3. A foldable trousers press as claimed in claim 1, wherein the base part and top part of each trousers press member are pivotally mounted together.

4. A foldable trousers press as claimed in claim 3 wherein the base part and top part of each trousers press member are connected together by means of at least one resilient plastics hinge which acts to hold the base and top parts slightly apart.

5. A foldable trousers press as claimed in claim 1 wherein the heating means comprises an electrically conductive plastics sheet.

6. A foldable trousers press as claimed in claim 1, wherein the trousers press members are of a width sufficient to accommodate only the front or rear positions of a pair of trousers to be pressed.

7. A foldable trousers press as claimed in claim 1, wherein an electrical socket is provided for receiving a plug to supply power to the heating means.

8. A foldable trousers press comprising:

at least two trousers press members of a width sufficient to accommodate only the front or rear portions of a pair of trousers to be pressed, each trousers press member comprising a base part and a top part;

pivoting means connecting the trousers press members together so as to be movable from a first position in a side-by-side relation to a second position in which the members are located in an end-to-end relationship so that the members together form the total length of the trousers press;

a hinge means connecting the base part and top part of each trousers press member together so that the top part and base part are movable between an open position and a closed position in which the respective base part and top part abut each other;

an electrically operated heating means for each trousers press member, fixed to at least one of said base part and top part, to heat a pair of trousers;

electrical connection means connecting the heating means of one member with the heating means of the other member;

a side region adjacent to said hinge means in each base part, each side region defining a recess which accommodates a locking member, the locking member being pivotable to the base member and rotatable so as to engage a cam surface recessed into the corresponding top part and force the top part and base part together; and a hanger means mounted at an end of the trousers press member which is uppermost in use, said hanger means being pivotally mounted on a rear surface of the base part and movable from a position in which the hanger means is accommodated in an elongated recess in the rear surface of the base part to a position in which the hanger means is perpendicular to the base part in the same plane, said hanger means having a free end that is weighted so that said hanger means remains generally horizontal when in use.

9. A foldable trousers press as claimed in claim 8, wherein the hinge means comprises a resilient plastics hinge which acts to urge the base and top parts slightly apart.

10. A foldable trousers press as claimed in claim 8, wherein the heating means comprises an electrically conductive plastics sheet.

11. A foldable trousers press as claimed in claim 8, wherein an electrical socket is provided for receiving a plug to supply power to the heating means.

* * * * *